US007789633B2

(12) United States Patent
Tash

(10) Patent No.: US 7,789,633 B2
(45) Date of Patent: Sep. 7, 2010

(54) AUTOMATICALLY DEFORMABLE NOZZLE REGULATOR FOR USE IN A VENTURI PUMP

(75) Inventor: George Tash, Somis, CA (US)

(73) Assignee: George Tash and Debra B. Tash, Somis, CA (US), as Trustees of Community Trust created under the George Tash and Debra B. Tash Intervivos Trust Agreement, dated Nov. 25, 1986, as amended ad totally restated on May 19, 1999, a Community Trust under the laws of the State of California.

( * ) Notice: Subject to any disclaimer, the term of this patent is extended or adjusted under 35 U.S.C. 154(b) by 1902 days.

(21) Appl. No.: 10/601,358

(22) Filed: Jun. 23, 2003

(65) Prior Publication Data

US 2004/0258535 A1 Dec. 23, 2004

(51) Int. Cl.
*F04F 5/36* (2006.01)

(52) U.S. Cl. ..... 417/198; 417/195

(58) Field of Classification Search ..... 417/198, 417/185, 195, 182, 193; 137/846, 844, 587, 137/583; 138/45; 60/779, 39.091, 39.094; 220/745–750

See application file for complete search history.

(56) References Cited

U.S. PATENT DOCUMENTS

| | | | | |
|---|---|---|---|---|
| 3,605,672 | A * | 9/1971 | Strumbos | 114/166 |
| 3,667,069 | A * | 6/1972 | Blackshear et al. | 623/3.1 |
| 4,963,073 | A | 10/1990 | Tash | |
| 6,250,890 | B1 * | 6/2001 | Popov | 417/195 |

* cited by examiner

*Primary Examiner*—Michael Cuff
*Assistant Examiner*—Vikansha S Dwivedi
(74) *Attorney, Agent, or Firm*—Lyon & Harr, L.L.P.; Craig S. Fischer

(57) ABSTRACT

The automatically deformable nozzle regulator described herein is for use in a venturi pump. The automatically deformable nozzle regulator automatically adjusts its output area as needed to provide an increased suction force at a venturi pump inlet. The nozzle regulator includes an outer tubular cylinder and an inner tubular cylinder, concentrically arranged, and an inlet section join the two cylinders at one end. The nozzle regulator is constructed of a flexible material, such that when a constricting force is applied an output area of the nozzle regulator is decreased. Fluid backpressure at the nozzle regulator caused by obstructions at the pump inlet or the head at the outlet cause backpressure and the resultant constricting force. Because the nozzle is deformable, the output area is reduced, thereby increasing suction force at the inlet to remove the obstruction and increased velocity at the outlet to increase the head at the outlet.

8 Claims, 5 Drawing Sheets

AUTOMATICALLY DEFORMABLE NOZZLE REGULATOR FOR USE IN A VENTURI PUMP

TECHNICAL FIELD

The present invention relates in general to nozzle regulators and more particularly to a nozzle regulator constructed of a deformable material and for use in a venturi pump that automatically adjusts its output area as needed to provide an increased suction force at an inlet of the venturi pump.

BACKGROUND OF THE INVENTION

Venturi pumps are useful devices that are utilized in a myriad of situations and applications. For example, venturi pumps are used in industrial applications and on construction sites to pump an assortment of fluids. In home applications, venturi pumps are used to drain pools, fountains, ponds, aquariums, sinks and in innumerable other applications.

Venturi pumps make use of a venturi to pump fluids from one area to another. In general, a venturi is a short tube having a tapering constriction (or throat) at or near the middle of the tube. This constriction causes the velocity of the fluid at the throat to increase and a corresponding decrease in fluid pressure. The low-pressure area created at the throat is particularly useful in measuring fluid flow and for creating a suction force. This suction force is used in many applications, such as for driving aircraft instruments and for drawing fuel into the flow stream of a carburetor.

One type of venturi pump that makes use of a venturi to create a suction force and draw fluid into the pump is discussed in U.S. Pat. No. 4,963,073 by Tash et al. entitled, "Water Pressure Operated Water Pump". Disclosed therein is a convenient, easy-to-use and inexpensive pump for pumping water. The device uses water pressure from a standard garden hose connection as the power to pump the water. The device has a primary inlet, a secondary inlet, and an outlet nozzle. The primary inlet is for inputting liquid (such as water from a garden hose tap) at a high velocity through a venturi. This high-velocity flow creates a low-pressure area at the throat and generates the motive power necessary to drive the pump. The secondary inlet is positioned at the throat and opens into the venturi at the throat. The fluid being pumped is drawn into the venturi through the secondary inlet. The output nozzle is for outputting the fluid combination from the primary and secondary inlets.

When the water from the garden hose tap flows under pressure into the primary inlet, the velocity of the water is greatly increased by a venturi that is positioned in the pumping chamber. The increased velocity of the water through the venturi causes a corresponding drop in pressure. This drop in pressure causes the pressure in the pumping chamber to be less than the pressure of the fluid to be pumped. This causes the fluid being pumped to be drawn through the secondary inlet into the pumping chamber and be ejected through the outlet nozzle.

In existing venturi pumps, the cross-sectional areas of the primary inlet, secondary inlet, throat, and outlet nozzle are fixed. This means that the inlet-to-throat area ratio and the throat-to-outlet nozzle area ratio are fixed. This leads to at least three problems with existing venturi pumps.

First, when a column of fluid (or head) at the outlet nozzle is high enough, the pump will be unable to pump the fluid any higher. This is because the motive force pumping the fluid through the outlet nozzle is in equilibrium with the weight of the fluid head at the outlet nozzle. A second problem with conventional venturi pumps is that if debris or other contaminants (such as leaves or rocks) block the secondary inlet the flow rate decreases and the pump performance suffers. In addition, viscous fluid (such as oil or a combination of water and mud) requires greater suction in the pumping chamber than a less viscous fluid (such as water). A third problem is that a rigid foreign object in the fluid being pumped (such as a rock) may be sucked through the secondary inlet and lodge in the outlet nozzle. In extreme situations, the foreign object may completely block the outlet nozzle, thereby effectively shutting down the pump. Therefore, what is needed is an improved venturi pump that overcomes the aforementioned problems to provide increased performance and usefulness without undue cost and complexity.

SUMMARY OF THE INVENTION

The automatically deformable nozzle regulator described herein is designed for use in a venturi pump. The nozzle regulator is constructed of a deformable material and automatically decreases its output area as needed to decrease the pressure at an inlet of the venturi pump and provide increased suction force. This increased suction force allows a venturi pump utilizing the present invention to overcome the aforementioned problems and provide increased performance and usefulness without undue cost and complexity.

In particular, the present invention helps alleviate the problem of debris blocking an inlet of the venturi pump. In this situation, as the resistance at the inlet increases, the output velocity of the fluid exiting the deformable nozzle regulator decreases, leading to a pressure increase (or fluid backpressure) around the nozzle regulator. This fluid backpressure imposes a constricting force on the nozzle regulator and reduces its output area. This in turn increases the venturi effect and provides an increased low-pressure area (or suction force) at the inlet such that any debris is dislodged, fragmented or disintegrated.

The present invention also alleviates the situation where the head is so great that the venturi pump is unable to pump fluid any higher. The increase in backpressure caused by the increased head causes the nozzle regulator to constrict or shrink, thereby increasing fluid velocity through the nozzle regulator. This often is enough to increase the height to which the venturi pump can raise the fluid. Moreover, the deformable nozzle regulator is better able than rigid nozzle regulators to deal with hard obstructions that may enter the venturi pump. The present invention is able to pass these obstructions more easily than fixed and rigid outlet nozzles. Once the obstruction has passed, the nozzle regulator returns to its original shape.

In general, the nozzle regulator contains three sections. Namely, an outer tubular section or cylinder, an inner tubular section or cylinder, and an inlet section. The outer cylinder and the inner cylinder are concentric. The nozzle regulator also contains an output nozzle. This output nozzle is formed by the offset to an outlet side of the inner cylinder such that the inner cylinder projects a distance from the outer cylinder. This projection of the output nozzle aids the nozzle regulator in taking full advantage of the backpressure effect.

The inlet section is a ring or disc having a convergent cross-sectional shape that joins the outer cylinder and the offset inner cylinder at an inlet side. The convergent cross-sectional shape of the inlet section can be a convex curve or a straight line. The nozzle regulator also includes a nozzle regulator cavity formed by the junction of the three above sections. Specifically, the cavity is formed by the space between the outer cylinder and the inner cylinder and bounded on the inlet side by the inlet section, while remaining open at the outlet side.

BRIEF DESCRIPTION OF THE DRAWINGS

The present invention can be further understood by reference to the following description and attached drawings that illustrate aspects of the invention. Other features and advantages will be apparent from the following detailed description of the invention, taken in conjunction with the accompanying drawings, which illustrate, by way of example, the principles of the present invention.

Referring now to the drawings in which like reference numbers represent corresponding parts throughout.

DETAILED DESCRIPTION OF THE INVENTION

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

The automatically deformable nozzle regulator described herein is designed to operate in a venturi-type pump. One such pump in which the invention may be used is described in U.S. Pat. No. 4,963,073 by Tash et al. entitled, "Water Pressure Operated Water Pump", the entire contents of which are hereby incorporated by reference. Throughout this specification, this venturi pump will be used to illustrate the operation of the automatically deformable nozzle regulator. It should be understood, however, that the automatically deformable nozzle regulator described herein may be used with other venturi-type pumps.

When incorporated into the venturi pump described in U.S. Pat. No. 4,963,073, the automatically deformable nozzle regulator transforms the venturi pump into an outlet side regulated venturi pump. This is achieved because the nozzle regulator of the present invention is made from a deformable material (such as rubber). Because the nozzle regulator is deformable, the throat-to-outlet area ratio is capable of being changed. In particular, the area of the outlet nozzle can be decreased by deformation of the nozzle regulator such that the throat-to-outlet area ratio is increased. From Bernoulli's equation, it follows that an increase in the throat-to-outlet area ratio leads to a decrease in pressure at the throat.

Once incorporated into the venturi pump described above, the automatically deformable nozzle regulator automatically determines when additional suction force (or low pressure) is needed at the throat and decreases its output area accordingly. As explained in detail below, this automatic determination is a physical phenomenon based on backpressure that the nozzle regulator experiences. Because the nozzle regulator is deformable, an increase in backpressure constricts the nozzle regulator and decreases its outlet area, thereby lowering the pressure at the throat and creating additional suction force.

Figure 1:
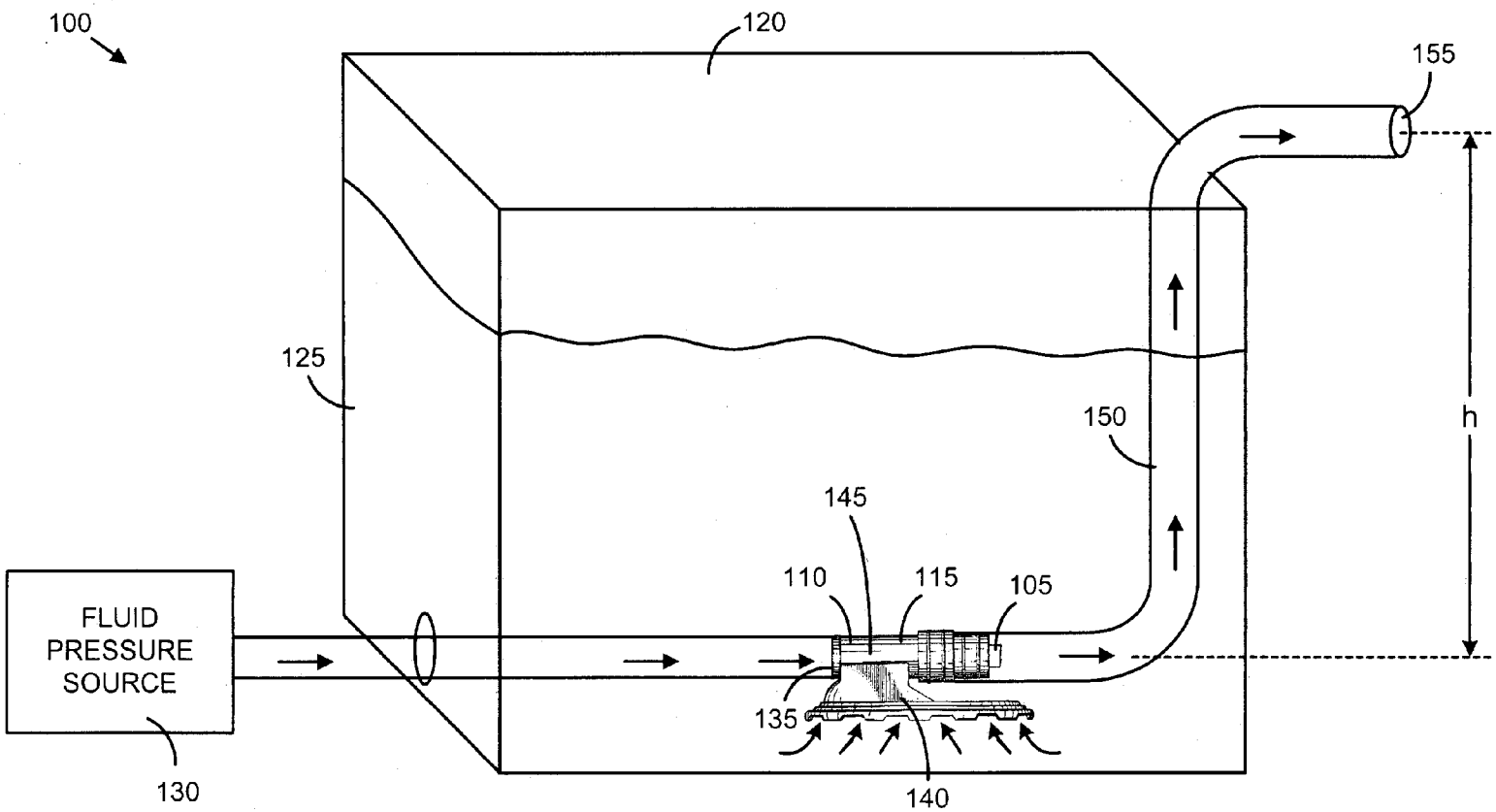
FIG. 1 illustrates an exemplary embodiment of a venturi pump containing the automatically deformable nozzle regulator described herein being used in a fluid-pumping environment and is shown for illustrative purposes only.

FIG. 1 illustrates an exemplary embodiment of a venturi pump containing the automatically deformable nozzle regulator described herein being used in a fluid-pumping environment and is shown for illustrative purposes only. In general, the fluid-pumping environment 100 includes the automatically deformable nozzle regulator 105 that is incorporated into a venturi pump body 110. This combination of the nozzle regulator 105 and the venturi body 110 creates an outlet side regulated venturi pump 115. The pump 115 is disposed in a fluid (such as water) and is used to draw the fluid into the pump and output the fluid at another location.

In particular, as shown in FIG. 1, the pump 115 is set in a tank 120 that contains water 125. It should be noted that in this particular example the fluid contained in the tank 120 is water 125, but could easily be another type fluid or even a combination of fluids (such as water and oil). A fluid pressure source 130 (such as a garden hose) is connected to a primary inlet 135 of the pump 115 to provide a motive force. As shown by the arrows, water under pressure is displaced from the fluid pressure source 130 through the pump 115. A secondary inlet 140 is in fluid communication with a throat 145. The velocity of the water 125 through the primary inlet 135 and the throat 145 creates a low-pressure area at the throat (and secondary inlet 140). This low-pressure area draws up the water 125 in the tank 120 into the secondary inlet 140 and into the throat where the incoming water mixes with water entering through the primary inlet 135. The combination of water then passes through the flexible nozzle regulator 115.

An outlet line 150 is connected to the outlet side of the pump 115 containing the automatically deformable nozzle regulator 105. The height of the output water ("h") within the outlet line 150 is known as the "head." Water output from the pump 115 is pushed through the outlet line 150 and at an outlet line end 155 to an area outside of the tank 120. In this manner, the water 125 is removed from the tank 120 by the pump 115.

II. Incorporation of the Automatically Deformable Nozzle Regulator

Figure 2:
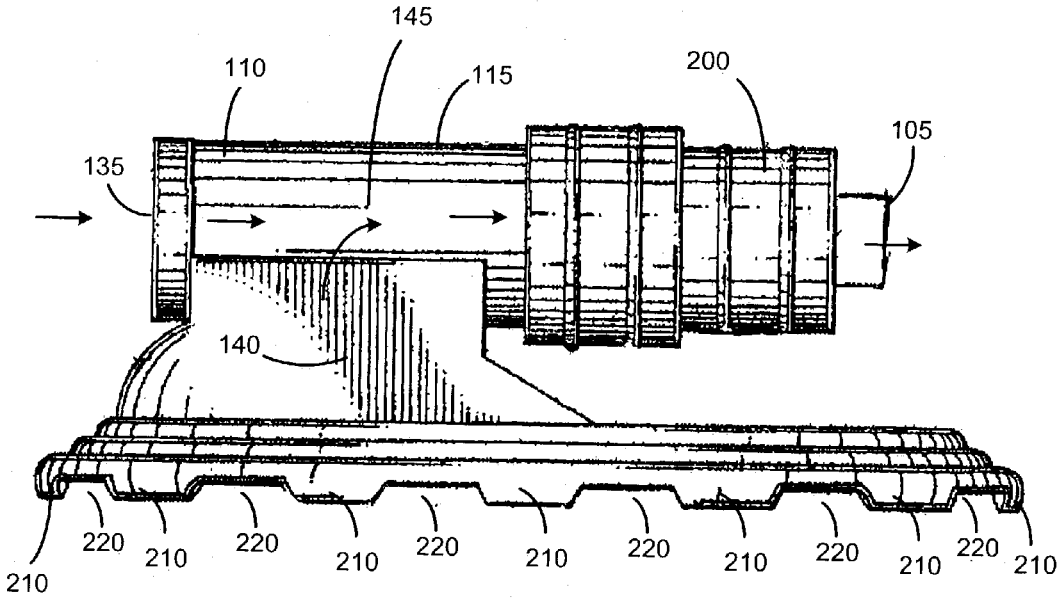
FIG. 2 illustrates a side view of the venturi pump and the automatically deformable nozzle regulator shown in FIG. 1.

The automatically deformable nozzle regulator of the present invention is designed to be incorporated into the outlet area of a venturi pump. FIG. 2 shows the incorporation of the regulator into the venturi pump discussed above. Specifically, FIG. 2 illustrates a side view of the venturi pump and the flexible nozzle regulator shown in FIG. 1.

As shown in FIG. 2, the pump 115 includes the primary inlet 135, the secondary inlet 140, and an outlet area containing the flexible nozzle regulator 105. An inlet line (not shown) attaches to the primary inlet 135. The outlet line 150 attaches to an outlet portion 200 of the pump body 110. Within the outlet portion 200 is housed the flexible nozzle regulator 105. The nozzle regulator 105 may be held in place by being press fitted into the outlet portion 200. Alternatively, the nozzle regulator 105 may be secured in place by means of a locking collar (not shown). The pump 115 also contains a plurality of feet 210 and notches 220 that are designed to elevate the pump 115 slightly and allow water to be admitted into the secondary inlet 140.

Figure 3:
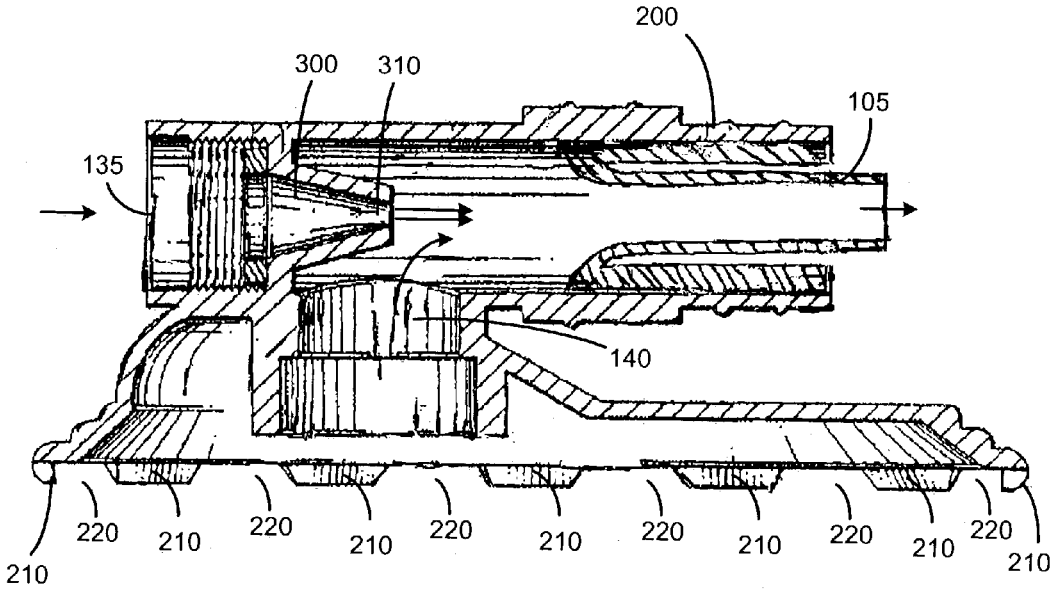
FIG. 3 illustrates a cutaway side view of the venturi pump and the automatically deformable nozzle regulator shown in FIGS. 1 and 2.

FIG. 3 illustrates a cutaway side view of the venturi pump 115 and the flexible nozzle regulator 105 shown in FIGS. 1 and 2. The primary inlet is in fluid communication with a venturi 300. The smallest radius portion of the venturi is the throat 310. The secondary inlet 140 is in fluid communication with the throat 310 as the inlet 140 opens into the throat 310. Downstream from the venturi 310 and within a cavity of the outlet portion 200 is disposed the automatically deformable nozzle regulator 105.

III. Structural Details of the Automatically Deformable Nozzle Regulator

Figure 4:
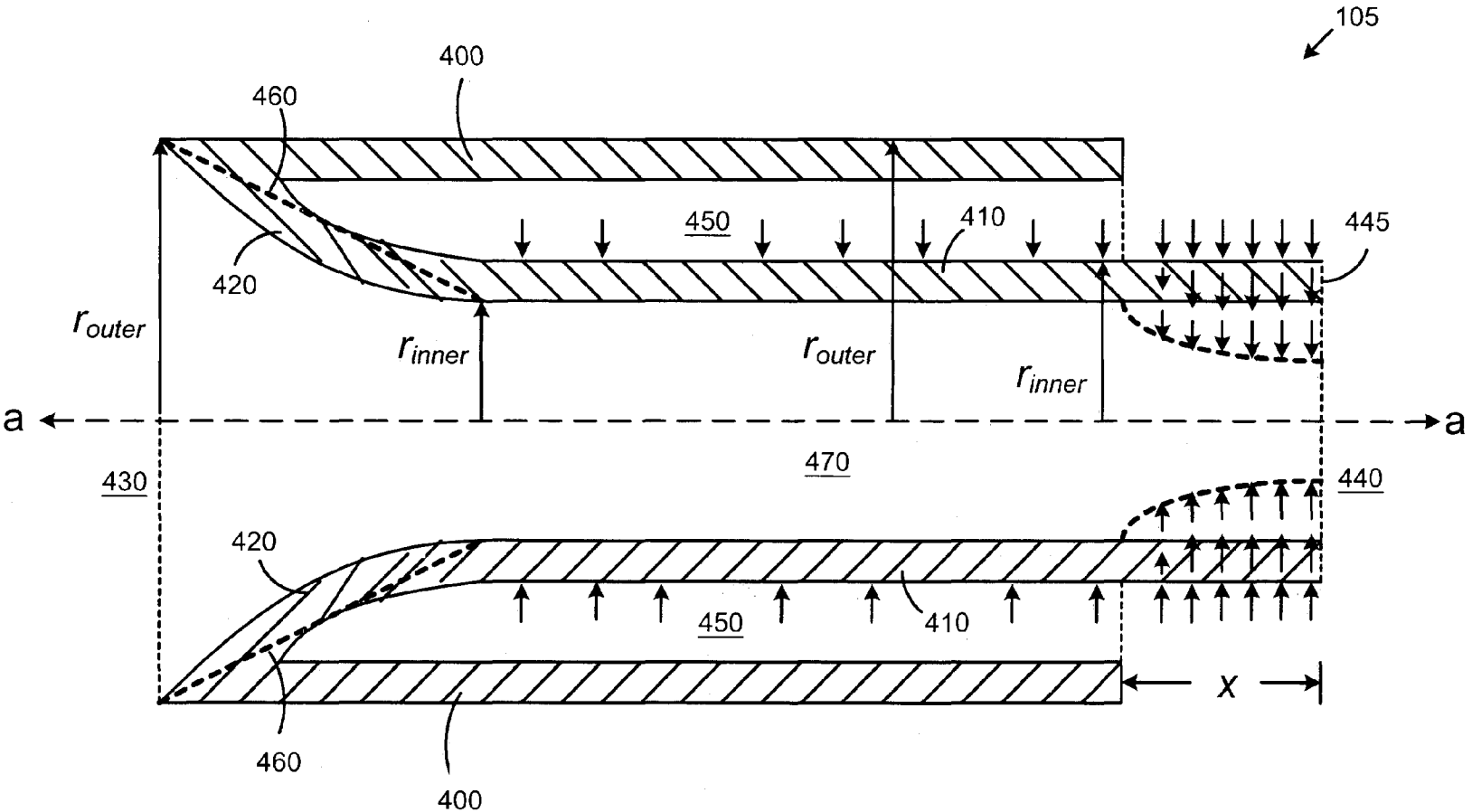
FIG. 4 illustrates a cutaway side view of the automatically deformable nozzle regulator shown in FIGS. 1-3.

FIG. 4 illustrates a cutaway side view of the automatically deformable nozzle regulator 105 shown in FIGS. 1-3. The nozzle regulator is made of a deformable material (such as rubber) so that when acted upon by a force the nozzle regulator easily deforms but when the force is removed the nozzle regulator returns to its original shape. The nozzle regulator 105 is formed into the shape shown in FIG. 4.

The details of the shape of the nozzle regulator 105 will now be discussed. In general, the nozzle regulator 105 contains three sections: (1) an outer tubular section or cylinder 400; (2) an inner tubular section or cylinder 410; and, (c) an inlet section 420. In particular, the outer tubular cylinder 400 has a first radius, $r_{outer}$, and the inner tubular cylinder 410 has a second radius $r_{inner}$, with $r_{outer}>r_{inner}$. The outer cylinder 400 and the inner cylinder 410 are concentric about a longitudinal axis, shown in FIG. 4 as imaginary dashed line a-a. At one end of the nozzle regulator 105, along the longitudinal axis, is an inlet side 430 and at the other end is an outlet side 440. In the longitudinal direction (along line a-a), the inner cylinder 410 is offset to the outlet side 440 such that inner cylinder 410 projects a distance, x, from the outer cylinder 400 in the longitudinal direction to create an outlet nozzle 445. As explained in detail below, this projection helps the nozzle regulator automatically deform based on backpressure in the venturi pump 115.

The inlet section 420 smoothly connects the outer cylinder 400 and the inner cylinder 410 at the inlet side 430. The inlet section 420 essentially is a ring or disc having a convergent cross-sectional shape (along the longitudinal axis a-a) that joins the outer cylinder 400 and the offset inner cylinder 410 at the inlet side 430. In other words, moving from the inlet side 430 to the outlet side 440 the cross-sectional shape of the inlet section 420 converges. This convergence can be seen by referring to FIG. 4, where the first radius, $r_{outer}$, at the inlet section 420 is greater than the second radius, $r_{inner}$, at the inlet section 420 (i.e., $r_{outer}>r_{inner}$).

In a preferred embodiment shown in FIG. 4, the convergent cross-sectional shape of the inlet section 420 is a convex curve that smoothly connects the outer cylinder 400 with the inner cylinder 410. In an alternative embodiment, convergent cross-sectional shape of the inlet section 420 is linear such that the outer cylinder 400 and the inner cylinder 410 are smoothly connected by a straight line. This embodiment is shown by the dashed convergent lines 460 connecting the outer cylinder 400 and the inner cylinder 410 at the inlet side 430.

The junction of the three above sections forms a nozzle regulator cavity 450 in the nozzle regulator 105. This cavity 450 is formed by the space between the outer cylinder 400 and the inner cylinder 410 and bounded on the inlet side 430 by the inlet section 420. At the outlet side 440 the cavity 450 is open. Within the inner cylinder 410 is a fluid passageway 470 where the fluid being pumped flows through the nozzle regulator 105.

Figure 5:
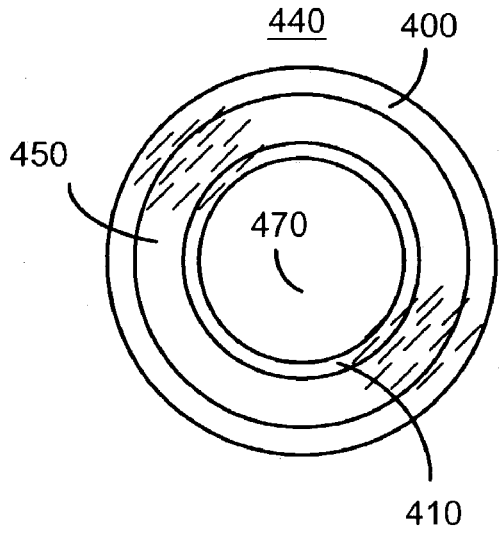
FIG. 5 illustrates an end view of the outlet side of the automatically deformable nozzle regulator shown in FIGS. 1-4.

FIG. 5 illustrates an end view of the outlet side 440 of the automatically deformable nozzle regulator 105 shown in FIGS. 1-4. Specifically, the outer cylinder 400 and the inner cylinder 410 are shown to be concentric. Moreover, the area between the two cylinders 400, 410 is the nozzle regulator cavity 450. It should be noted that, as illustrated in FIG. 5, the cavity 450 is open on the outlet side 440 but closed on the inlet side. The fluid passageway 470 formed by the inner cylinder 410 and extends through the entire nozzle regulator 105 such that fluid can flow through the passageway 470.

Figure 6:
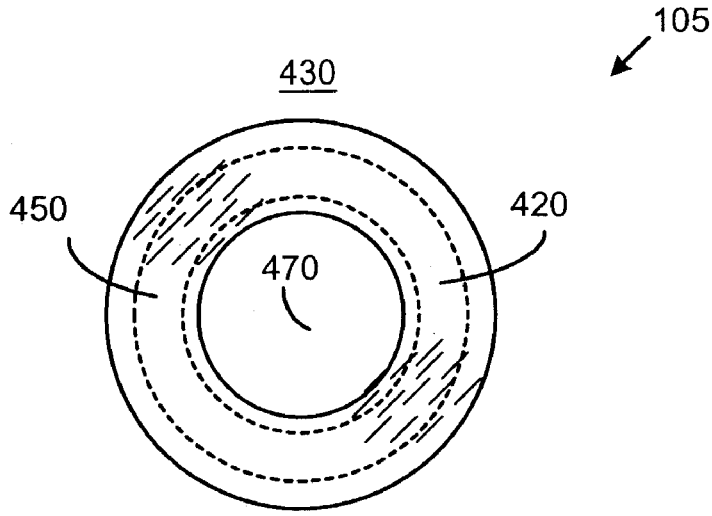
FIG. 6 illustrates an end view of the inlet side of the automatically deformable nozzle regulator shown in FIGS. 1-4.
Figure 7:
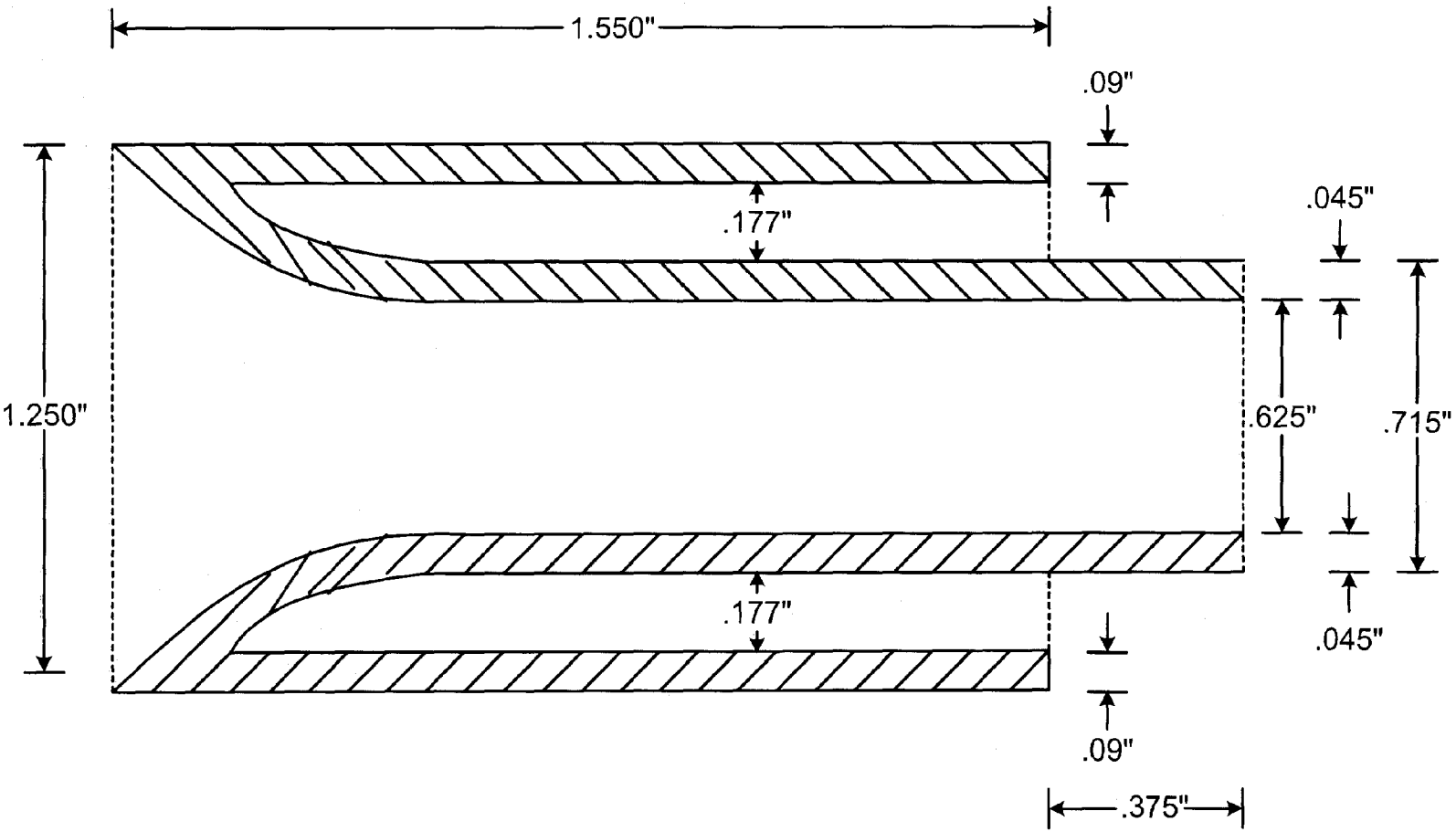
FIG. 7 illustrates the dimensions of an exemplary embodiment of the automatically deformable nozzle regulator as shown in FIGS. 1-4.

FIG. 6 illustrates an end view of the inlet side 430 of the automatically deformable nozzle regulator 105 shown in FIGS. 1-4. As shown by the dashed lines, the ends of the outer cylinder 400 and the inner cylinder 410 as well as the nozzle regulator cavity 450 are hidden by the 420 inlet section. The fluid passageway 470 allows fluid to enter and pass through the nozzle regulator 105. FIG. 7 illustrates the dimensions of an exemplary embodiment of the automatically deformable nozzle regulator 105 as shown in FIGS. 1-6.

IV. Operation of the Automatically Deformable Nozzle Regulator

The automatically deformable nozzle regulator described herein automatically adjusts its output area as needed to provide an increased low-pressure area at an inlet of the venturi pump. This change in output area is achieved by decreasing the radius of the inner cylinder, $r_{inner}$, at the outlet side 440 such that the output area is decreased. This decrease in the inner cylinder radius, $r_{inner}$, is achieved using backpressure from the fluid. Because of the deformable nature of the nozzle regulator 105, when the backpressure is great enough the inner cylinder radius, $r_{inner}$, constricts thereby decreasing $r_{inner}$. Once the backpressure is relieved, the deformable nature of the nozzle regulator 105 causes $r_{inner}$ to return to its original value.

The details will now be explained with reference to FIGS. 1, 3 and 4. One situation that may occur during the pumping of fluid is where debris (such as a rock or leaves) is blocking the secondary inlet 140. In this situation, as the resistance at the secondary inlet 140 increases, the output velocity of the fluid exiting the nozzle regulator 105 decreases. This decrease in fluid velocity leads to a pressure increase in the nozzle regulator cavity 450 and around the outside of the outlet nozzle 445. This pressure increase is caused by fluid backpressure. The inner cylinder 410 is offset from the outer cylinder 400 such that the output nozzle 445 is formed in order to increase the surface area of the inner cylinder 410 exposed to the backpressure and take full advantage of the backpressure effect.

The backpressure effect causes the radius of the outlet nozzle 445 to decrease, as shown by the arrows in FIG. 4. This in turn increases the venturi effect and provides an increased low-pressure area (or suction force) at the secondary inlet 140 by lowering the pressure at the secondary inlet 140. The decrease in the radius of the outlet nozzle 445 is shown in FIG. 4 by the dashed lines. As will be appreciated, the decrease in the radius of the outlet nozzle 445 leads to a decrease in cross-sectional area at the outlet nozzle 445 and a corresponding decrease in pressure at the secondary inlet 140. Usually this increase in suction force is enough to dislodge, fragment or disintegrate any debris blocking the secondary inlet 140.

Another situation that may occur is the situation where the head, h, in the outlet line 150 is so high that the pump 115 is unable to pump fluid any higher. This occurs when motive force pumping the fluid through the outlet line 150 is in equilibrium with the weight of the fluid in the head. As the head of the outlet line increases, however, the backpressure also increases. The increase in backpressure occurs in the nozzle cavity and around the outside of the output nozzle 445. This increase in backpressure causes the outlet nozzle 445 to constrict or shrink because of a "backpressure pocket" that develops within the nozzle regulator cavity 450. The inner cylinder radius at the output nozzle 445 decreases causing an increase in fluid velocity at the output nozzle 445. This increase in fluid velocity often is enough to increase the height to which the pump 115 can raise the fluid.

Yet another situation occurs when a rigid foreign object in the fluid being pumped (such as a rock) is drawn through the secondary inlet 140. Because the nozzle regulator 105 is constructed of a deformable material, the nozzle regulator 105 is able to pass debris more easily than fixed and rigid outlet nozzles. Due to it deformable nature, the inner cylinder 410 is able open up (expand) to allow the debris to pass easily through the nozzle regulator 105. The inner cylinder 410 then returns to its original shape once the obstruction has passed.

The foregoing description of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description of the invention, but rather by the claims appended hereto.

What is claimed is:

1. A nozzle regulator, comprising:

an outer tubular cylinder having a first radius;

an inner tubular cylinder having a second radius that is less than the first radius, wherein the outer tubular cylinder and the inner tubular cylinder are concentric about a longitudinal direction; and an inlet section that connects the outer tubular cylinder and the inner tubular cylinder at an inlet side in the longitudinal direction;

wherein the entire nozzle regulator is made of a deformable material such that when a fluid within the inner tubular cylinder experiences a backpressure, the second radius automatically decreases, but when the backpressure is removed the second radius automatically increases back to its original dimension.

2. An automatically deformable nozzle regulator, comprising:

an outer cylinder having a hollow interior and an inlet side and a outlet side at opposite end of the cylinder along a longitudinal direction;

an inner cylinder disposed concentrically within the outer cylinder and having a fluid passageway in the longitudinal direction such that fluid can flow through the fluid passageway from the inlet side to the outlet side; and an inlet section having a convergent cross-sectional shape that connects the outer cylinder and the inner cylinder at the inlet side such that the fluid enters the nozzle regulator at the inlet section and flows into the fluid passageway;

wherein the automatically deformable nozzle regulator is constructed of a deformable material.

3. An deformable nozzle regulator, comprising:

an outer cylinder having a hollow interior and an inlet side and an outlet side at opposite end of the cylinder along a longitudinal direction:

an inner cylinder disposed concentrically within the outer cylinder and having a fluid passageway in the longitudinal direction such that fluid can flow through the fluid passageway from the inlet side to the outlet side;

an inlet section having a convergent cross-section shape that connects the outer cylinder and the inner cylinder at the inlet side such that the fluid enters the nozzle regulator at the inlet section and flows into the fluid passageway; and a nozzle regulator cavity bounded by the outer cylinder, the inner cylinder and the inlet section such that the inlet side of the nozzle regulator cavity is sealed and the outlet side of the nozzle regulator cavity is open so that fluid can only flow into the nozzle regulator cavity from the outlet side;

wherein the automatically deformable nozzle regulator is constructed of a deformable material.

4. The automatically deformable nozzle regulator as set forth in claim 3, wherein a backpressure in the fluid within the nozzle regulator cavity generates a constricting force that causes a radius of the inner cylinder to decrease.

5. An automatically deformable nozzle regulator, comprising:

an outer cylinder having a hollow interior and an inlet side and an outlet side at opposite end of the cylinder along a longitudinal direction; an inner cylinder disposed concentrically within the outer cylinder and having a fluid passageway in the longitudinal direction such that fluid can flow through the fluid passageway from the inlet side to the outlet side;

an inlet section having a convergent cross-sectional shape that connects the outer cylinder and the inner cylinder at the inlet side such that the fluid enters the nozzle regulator at the inlet section and flows into the fluid passageway; and an output nozzle projecting from the outlet side of the outer cylinder and being part of the inner cylinder such that a surface area of the output nozzle is capable of being in contact with the fluid;

wherein the automatically deformable nozzle regulator is constructed of a deformable material.

6. The automatically deformable nozzle regulator as set forth in claim 5, wherein a backpressure in fluid surrounding the output nozzle generates a constricting force causing a radius of the inner cylinder to decrease.

7. The automatically deformable nozzle regulator as set forth in claim 2, wherein the deformable material comprises rubber.

8. An outlet side regulated venturi pump for pumping fluid, comprising:

a primary inlet that receives a fluid pressure source such that fluid under pressure flows from the fluid pressure source to the primary inlet;

a venturi throat in fluid communication with the primary inlet that decelerates the fluid flowing from the primary inlet and creates a low-pressure area within a cavity located at an outlet of the venturi throat;

a secondary inlet in fluid communication with the venturi throat and cavity that allows a fluid being pumped to be drawn through the secondary inlet into the cavity by the low-pressure area in the cavity; and an automatically deformable nozzle regulator in fluid communication with the venturi throat and cavity that automatically adjusts its output area to further decrease the pressure in the cavity, wherein the nozzle regulator comprises, an outer tubular cylinder and an inner tubular cylinder concentrically arranged, an inlet section joining the cylinders at an inlet side of the nozzle regulator, and a nozzle regulator cavity disposed between the concentric cylinders, wherein the nozzle regulator cavity is bounded on the inlet side by the inlet section and open on the outlet side.

* * * * *

UNITED STATES PATENT AND TRADEMARK OFFICE

CERTIFICATE OF CORRECTION

PATENT NO. : 7,789,633 B2
APPLICATION NO. : 10/601358
DATED : September 7, 2010
INVENTOR(S) : George Tash It is certified that error appears in the above-identified patent and that said Letters Patent is hereby corrected as shown below:

Column 7, line 21, delete "an inlet section that connects the outer tubular cylinder and the inner tubular cylinder at an inlet side in the logitudinal direction;".

line 24, change "entire nozzle regulator" to --inner tubular cylinder--.

line 29, change "." to --; and--.

line 29, insert --an inlet section that connects the outer tubular cylinder and the inner tubular cylinder at an inlet side in the longitudinal direction-- after "; and".

line 30, change "An automatically deformable nozzle regulator, comprising: an outer cylinder having a hollow interior and an inlet side and a outlet side at opposite end of the cylinder along a longitudinal direction; an inner cylinder disposed concentrically within the outer cylinder and having a fluid passageway in the longitudinal direction such that fluid can flow through the fluid passageway from the inlet side to the outlet side; and an inlet section having a convergent cross-sectional shape that connects the outer cylinder and the inner cylinder at the inlet side such that the fluid enters the nozzle regulator at the inlet section and flows into the fluid passageway; wherein the automatically deformable nozzle regulator is constructed of a deformable material." to --The nozzle regulator as set forth in claim 1, wherein the entire nozzle regulator is constructed of the deformable material.--.

Column 8, line 31, delete "7. The automatically deformable nozzle regulator as set forth in claim 2, wherein the deformable material comprises rubber.".

line 34, change "8" to --7--.

line 50, change "," to --.--.

line 50, change "wherein the nozzle regulator comprises" to --8. The outlet side regulated venturi pump as set forth in claim 7, wherein the automatically deformable nozzle regulator further comprises:--.

line 53, change "," to --; and--.

line 55, change ", and" to --.--.

line 56, insert --9. The outlet side regulated venturi pump as set forth in claim 8, wherein the automatically deformable nozzle regulator further comprises-- before "a nozzle".

line 57, change ", wherein the nozzle regulator cavity is" to --and--.

Signed and Sealed this

Twenty-sixth Day of October, 2010

David J. Kappos

David J. Kappos
*Director of the United States Patent and Trademark Office*